US008446029B2

(12) United States Patent
Smith et al.

(10) Patent No.: US 8,446,029 B2
(45) Date of Patent: May 21, 2013

(54) TURBOMACHINERY DEVICE FOR BOTH COMPRESSION AND EXPANSION

(75) Inventors: William Joseph Smith, Morristown, NJ (US); Vai Man Lei, Morristown, NJ (US); Mike Guidry, Morristown, NJ (US)

(73) Assignee: Honeywell International Inc., Morristown, NJ (US)

( * ) Notice: Subject to any disclaimer, the term of this patent is extended or adjusted under 35 U.S.C. 154(b) by 566 days.

(21) Appl. No.: 12/754,433

(22) Filed: Apr. 5, 2010

(65) Prior Publication Data

US 2011/0241344 A1 Oct. 6, 2011

(51) Int. Cl.
*F01D 15/10* (2006.01)

(52) U.S. Cl.
USPC ..... 290/52

(58) Field of Classification Search
USPC ..... 290/52; 415/2.1
See application file for complete search history.

(56) References Cited

U.S. PATENT DOCUMENTS

| | | | |
|---|---|---|---|
| 3,356,289 | A | 12/1967 | Plotkowiak |
| 3,756,739 | A | 9/1973 | Boussuges |
| 4,177,005 | A | 12/1979 | Bozung et al. |
| 4,439,983 | A | 4/1984 | Gertz |
| 5,544,484 | A | 8/1996 | Voss et al. |
| 5,559,379 | A | 9/1996 | Voss |
| 5,818,117 | A | 10/1998 | Voss et al. |
| 6,050,775 | A | 4/2000 | Erdmann et al. |
| 6,094,909 | A | 8/2000 | Weber et al. |
| 6,276,139 | B1 | 8/2001 | Moraal et al. |
| 6,584,963 | B2 | 7/2003 | Arnold |
| 7,152,393 | B2 | 12/2006 | Hergemöller et al. |
| 2003/0140630 | A1 | 7/2003 | Baeuerle et al. |
| 2003/0167751 | A1 | 9/2003 | Paffrath et al. |
| 2007/0007771 | A1 | 1/2007 | Biddle et al. |
| 2007/0062192 | A1 | 3/2007 | Weber et al. |
| 2007/0107429 | A1 | 5/2007 | Squires |

(Continued)

FOREIGN PATENT DOCUMENTS

| | | |
|---|---|---|
| DE | 32 05 722 | 8/1983 |
| EP | 0 147 740 A2 | 12/1984 |

(Continued)

OTHER PUBLICATIONS

Müller et al.; *Using the Centrifugal Compressor as a Cold Air Turbine*; pp. 1-13; 2006 DaimlerChrysler AG.

(Continued)

*Primary Examiner* — Tho D Ta
(74) *Attorney, Agent, or Firm* — Alston & Bird LLP

(57) ABSTRACT

A turbomachinery device operable in either a compressor mode or a turbine mode. The device includes an impeller that rotates in the same direction in both modes, and the general flow direction remains the same in both modes. An inlet flow-guiding device may be included to direct fluid into the impeller. The impeller is coupled to a motor/generator, which operates as a motor to add power to the impeller in the compressor mode, and as a generator in the turbine mode to extract mechanical power from the impeller and convert it into electrical power. An outlet flow-guiding device may also be included. The inlet and outlet flow-guiding devices can be inlet and outlet guide vanes that are variable in setting angle or are extendable and retractable into and out of the flow path, or can be other types of flow-guiding devices.

19 Claims, 4 Drawing Sheets

U.S. PATENT DOCUMENTS

| | | | | |
|---|---|---|---|---|
| 2008/0095610 | A1 | 4/2008 | Bosen | |
| 2009/0060719 | A1 | 3/2009 | Haugen | |
| 2010/0060013 | A1* | 3/2010 | Csefko | 290/55 |
| 2011/0094230 | A1* | 4/2011 | Finkenrath et al. | 60/727 |
| 2011/0100010 | A1* | 5/2011 | Freund et al. | 60/659 |
| 2011/0265882 | A1 | 11/2011 | Reyenga et al. | |
| 2011/0271936 | A1 | 11/2011 | Reyenga et al. | |

FOREIGN PATENT DOCUMENTS

| | | | |
|---|---|---|---|
| EP | 0 344 902 | A2 | 12/1989 |
| EP | 0 360 569 | A2 | 3/1990 |
| EP | 1 158 141 | A2 | 11/2001 |
| EP | 0 770 189 | | 2/2002 |
| JP | 51-143122 | | 12/1976 |
| JP | 60-182316 | A | 9/1985 |
| JP | 04-241704 | A | 8/1992 |
| JP | 2008-157150 | A | 7/2008 |
| KR | 20060055430 | A | 5/2006 |
| WO | WO 92/09800 | A1 | 6/1992 |
| WO | WO 96/04487 | A1 | 2/1996 |
| WO | WO 2009/092670 | A1 | 7/2009 |
| WO | WO 2010/043910 | A1 | 4/2010 |

OTHER PUBLICATIONS

Onder et al.; *Modelling and Control of an Active Throttle for SI Engines*; IFAC Advances in Automotive Control; Salerno, Italy; 2004; pp. 155-160; Elsevier Publications.

Guzzella et al.; *Recuperative Throttling of SI Engines for Improves Fuel Economy*; 2004 SAE International (6 pgs.).

Tomićet al.; *Spark ignition Engine Part Load Fuel Economy Improvement: Numberical Consideration*; FME Transactions; 2003; pp. 21-26; vol. 31, No. 1; Faculty of Mechanical Engineering; Belgrade.

International Search Report for Application No. PCT/US2011/034018 dated Dec. 13, 2011.

Eichhorn, et al., "Throttle Loss Recovery Using a Variable Geometry Turbine," SAE International, published May 5, 2010, 19 pages.

International Search Report and Written Opinion for International Application No. PCT/US2011/028015, mailed Sep. 20, 2011.

Extended Search Report for European Application No. 08150565.3, mailed Jul. 7, 2008.

Eichhorn, R.H.L., et al.; Waste Energy Driven Air Conditioning System (WEDACS); SAE International Technical Papers; Paper No. 2009-24-0063; Published Sep. 13, 2009; DOI: 10.4271/2009-24/0063.

* cited by examiner

TURBOMACHINERY DEVICE FOR BOTH COMPRESSION AND EXPANSION

BACKGROUND OF THE INVENTION

The present disclosure generally relates to flow-control devices and methods. More particularly, the present disclosure relates to devices and methods for adding power to and extracting power from a flowing fluid.

BRIEF SUMMARY OF THE DISCLOSURE

The present disclosure describes embodiments of devices and methods for selectively compressing a fluid (in a compressor mode) or extracting power (in a turbine mode) from the fluid. The devices and methods described herein operate essentially in continuous-flow fashion, as opposed to "batch-flow" type devices and methods such as reciprocating piston-type devices and methods. In accordance with the devices and methods described herein, the general direction of flow remains the same in both the compressor and turbine modes (i.e., the flow does not reverse direction for one mode relative to the other mode).

In accordance with one embodiment described herein, a turbomachinery device for selective compression of a fluid or extraction of power from the fluid comprises an impeller mounted for rotation about an axis, fluid flowing through the impeller in a flow direction, the impeller rotating in a first direction about the axis.

The turbomachinery device further comprises a motor/generator coupled with the impeller. The motor/generator is selectively operable either as a motor to rotatably drive the impeller which in turn compresses the fluid, or as a generator to generate electrical power when the fluid rotatably drives the impeller.

Accordingly, the turbomachinery device is selectively operable either in a compressor mode wherein the motor/generator is operated as a motor to rotate the impeller in the first direction to compress the fluid, or in a turbine mode wherein the fluid rotates the impeller in the first direction so as to rotate the motor/generator which produces electrical power.

The device in some embodiments can also include an inlet flow-guiding device positioned upstream of the impeller with respect to the flow direction and structured and arranged to receive a flow of fluid and direct the fluid into the impeller. The inlet flow-guiding device can comprise a variable-geometry mechanism that is selectively configurable in at least first and second positions, the first position causing the fluid to be directed into the impeller with a first swirl, the second position causing the fluid to be directed into the impeller with a second swirl. It will be understood that as used herein, "swirl" does not necessarily denote a non-zero component of swirl in the flow; thus references to a flow-guiding device directing fluid with a "swirl" can include a situation where the fluid is directed with zero swirl.

In one embodiment described herein, the inlet flow-guiding device comprises an array of inlet guide vanes pivotable in unison about respective vane pivot axes for regulating a direction in which the fluid enters the impeller, and an actuator mechanism coupled with the inlet guide vanes and operable to pivot the inlet guide vanes.

Alternatively, the inlet flow-guiding device can comprise an array of non-pivotable inlet guide vanes that are extendable and retractable either into or out of the fluid stream approaching the impeller. In the extended position, the inlet guide vanes impart non-zero swirl to the flow entering the impeller; in the retracted position, the flow enters the impeller with zero swirl.

As yet another alternative, the inlet flow-guiding device can comprise a volute for imparting swirl to the flow entering the impeller. In one variation on this concept, a branched conduit structure can be provided upstream of the impeller, having a first branch leading into the volute and a second branch that bypasses the volute. A suitable switch valve can be provided for selectively directing the fluid either into the first branch leading into the volute (and from there into the impeller), or into the second branch (and from there into the impeller). Thus, when the fluid passes through the volute, a non-zero swirl is imparted to the fluid before it reaches the impeller; when the fluid bypasses the volute, the fluid approaches the impeller with essentially no swirl.

The impeller can be either an axial-flow impeller or a centrifugal impeller, or even a mixed-flow (radial-axial) impeller. The axial-flow type may be preferable in some cases for ease of packaging and for compatibility with the inlet flow-guiding device.

The turbomachinery device can further comprise an outlet flow-guiding device positioned downstream of the impeller with respect to the flow direction. The outlet flow-guiding device regulates a direction in which the fluid exits the turbomachinery device. The outlet flow-guiding device can have variable geometry (similar to the inlet flow-guiding device described above) and an actuator mechanism can be coupled with the outlet flow-guiding device. In the compressor mode the actuator mechanism can be operable to position the outlet flow-guiding device in such a position that the outlet flow-guiding device diffuses the fluid passing therethrough.

In one embodiment, the actuator mechanism is operable to position the inlet flow-guiding device and the outlet flow-guiding device in cooperation with each other as the turbomachinery device is switched between the compressor mode and the turbine mode.

Because the impeller always rotates in the first direction in both the compressor mode and the turbine mode, the optimum or suitable camber of the impeller blades for the modes will be in different directions. Accordingly, the impeller can have blades whose camber is fixed and is in a direction more suitable for the compressor mode than for the turbine mode. Alternatively, fixed-camber blades could be employed having a camber in a direction more suitable for the turbine mode than for the compressor mode, depending on the needs in a particular application.

In a further embodiment, the blades can have variable camber that can be varied for the two modes of operation.

The present disclosure also describes methods for selectively expanding a fluid to extract energy therefrom or compressing the fluid. In one embodiment a method comprises steps of directing the fluid into an impeller rotating in a first direction about an axis of the impeller, and selectively performing each of the following steps at different times: (1) directing the fluid into the impeller while concurrently adding power to the impeller to rotate the impeller in the first direction such that the impeller compresses the fluid passing through the impeller; (2) directing the fluid into the impeller such that the fluid causes the impeller to rotate in the first direction, while concurrently extracting power from the impeller.

In one embodiment described herein, the directing steps are performed with the aid of an inlet flow-guiding device comprising a variable-geometry mechanism that is selectively configurable in at least first and second positions, the first position causing the fluid to be directed into the impeller with a first swirl, the second position causing the fluid to be directed into the impeller with a second swirl.

The method can further comprise the step of guiding the fluid that has exited the impeller using an outlet flow-guiding device.

In one embodiment, the steps of adding power to and extracting power from the impeller are performed with a motor/generator selectively operable either as a motor to add power to the impeller or as a generator to extract mechanical power from the impeller and convert the mechanical power into electrical power.

The method can further comprise the steps of positioning the outlet flow-guiding device in one position when the inlet flow-guiding device is in the first position, and positioning the outlet flow-guiding device in another position when the inlet flow-guiding device is in the second position.

An actuator mechanism can be employed to move the inlet flow-guiding device between the first position and the second position and to move the outlet flow-guiding device between the one position and the other position.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1A:
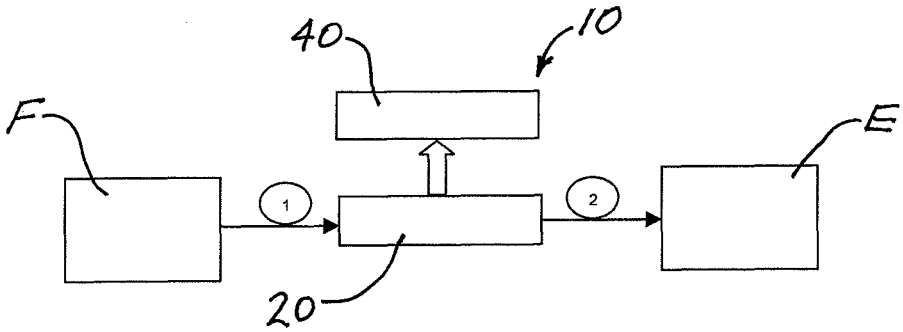
FIG. 1A is a schematic depiction of an engine system that includes a turbomachinery device in accordance with one embodiment of the invention claimed in the appended claims, showing the device operating in a turbine mode.
Figure 1B:
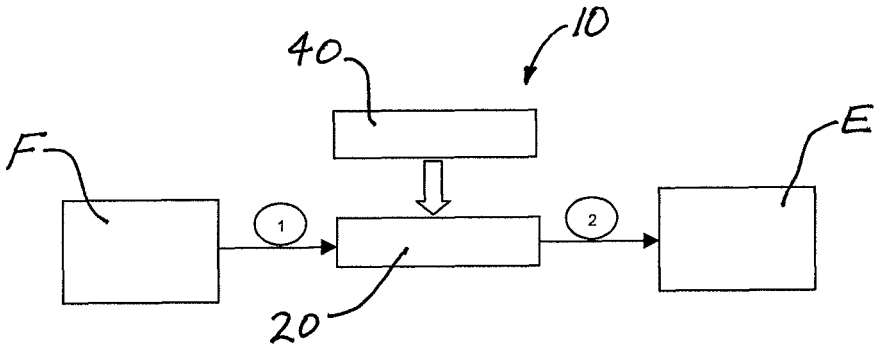
FIG. 1B is similar to FIG. 1A, showing the device operating in a compressor mode.

FIGS. 1A and 1B illustrate one possible application of the turbomachinery device 10 of the present invention, in an internal combustion engine system. The system includes an internal combustion engine E that ingests air along with a fuel and combusts the air-fuel mixture in the cylinders and discharges exhaust gases in the usual fashion. An air filter F filters the air before it is ingested by the engine. The turbomachinery device 10 is disposed in the intake air stream so that air passes through the device 10 before it reaches the engine.

The device 10 includes an impeller assembly 20 and a motor/generator 40. Various embodiments of the impeller assembly are described below and are illustrated in FIGS. 2-6. For purposes of description of FIGS. 1A and 1B, suffice it to say that the impeller assembly includes at least an impeller or rotor that rotates about an axis. The impeller is coupled to the motor/generator 40 such that the impeller can be driven by, or can drive, the motor/generator, depending on the mode of operation.

FIG. 1A shows a turbine mode of operation of the device 10, in which the air stream flowing through the impeller assembly 20 causes the impeller to rotate so as to drive the motor/generator 40, which operates as a generator and converts the mechanical power of the impeller into electrical power. Thus, the pressure $P_2$ of the air exiting the device 10 is lower than the pressure $P_1$ entering the device.

FIG. 1B shows a compressor mode of operation of the device 10, in which the motor/generator 40 operates as a motor and rotatably drives the impeller, which compresses the air flowing through it and delivers it for supply to the engine. Thus, the pressure $P_2$ of the air exiting the device 10 is higher than the pressure $P_1$ entering the device.

In accordance with the present invention, the impeller rotates in the same direction in the turbine mode as in the compressor mode.

Figure 2:
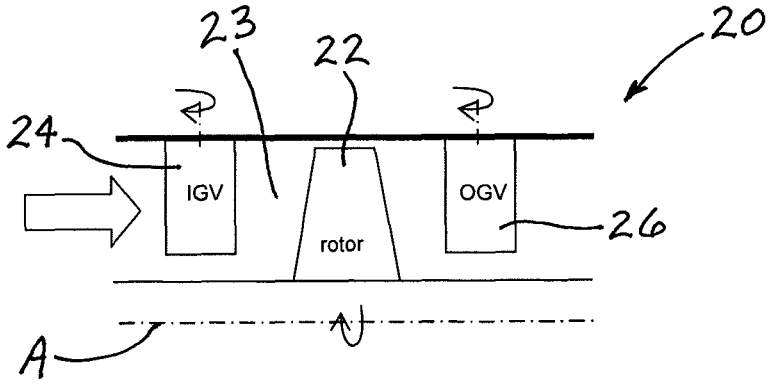
FIG. 2 is a diagrammatic illustration of an impeller assembly for a turbomachinery device in accordance with one embodiment of the invention.

With reference to FIG. 2, an impeller assembly 20 in accordance with one embodiment of the invention is schematically illustrated. The impeller assembly includes an impeller 22 disposed in a flow path 23. The impeller 22 can be an axial-flow impeller as shown, or a centrifugal impeller, or a mixed-flow impeller. The impeller rotates about an axis A. In this embodiment, the impeller assembly also includes an array of variable inlet guide vanes (IGVs) 24 and an array of variable outlet guide vanes (OGVs) 26 respectively located upstream of and downstream of the impeller 22. The variable IGVs and variable OGVs are pivotable about respective vane pivot axes so as to vary the setting angles of the vanes, which operates to alter the change in swirl imparted by the vanes to the air flowing through the vane arrays. For example, when the flow entering the IGVs has no swirl (i.e., no tangential component of velocity) and the IGVs are oriented in a "neutral" fashion (i.e., with their vane angles substantially aligned with the incoming flow direction), the IGVs impart substantially no change in swirl to the flow, so the flow exits the IGVs with no swirl. On the other hand, when the IGVs are pivoted from that neutral position, they impart swirl to the flow going into the impeller.

Depending on the specifics of a particular configuration, the flow (in the absolute frame of reference) coming out of the impeller 22 may have swirl. The OGVs can be used to regulate the direction of flow exiting the impeller assembly 20. For example, the OGVs can be set "neutral" with respect to the flow exiting the impeller so that the OGVs impart substantially no change in swirl to the flow; alternatively, the OGVs can be set so as to alter the swirl coming out of the impeller. As an example, when the device 10 is operating in the compressor mode, with the impeller 22 compressing the air flowing through it, the OGVs can be set so as to turn the flow back toward axial, which results in the fluid being diffused (i.e., velocity is reduced and static pressure is increased). Further examples are discussed below in connection with FIGS. 5 and 6.

Figure 3A:
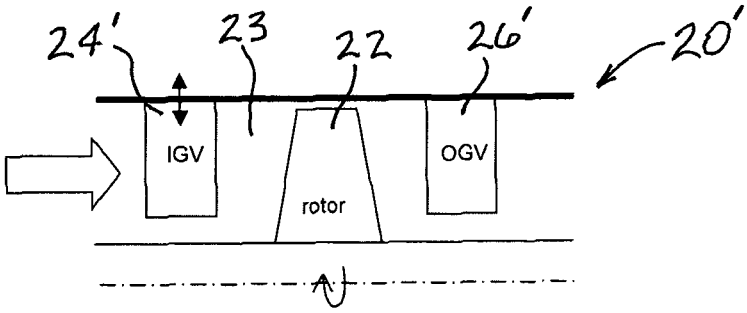
FIG. 3A is a diagrammatic illustration of an impeller assembly for a turbomachinery device in accordance with another embodiment of the invention, showing the device in a turbine mode.
Figure 3B:
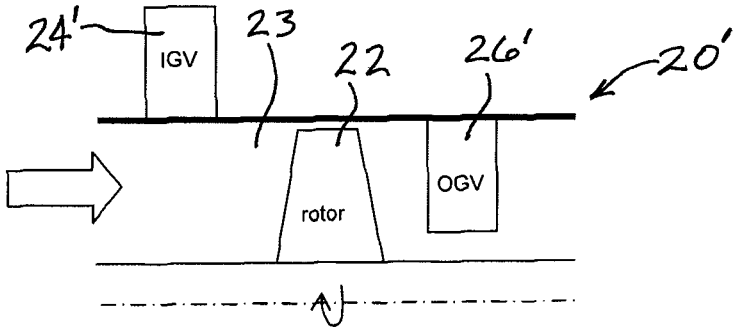
FIG. 3B shows the device of FIG. 3A operating in a compressor mode.

FIGS. 3A and 3B illustrate an alternative embodiment of an impeller assembly 20' in accordance with the invention. The impeller assembly 20' differs from the impeller assembly 20 with respect to the IGVs and OGVs. The IGVs 24' in the impeller assembly 20' are not pivotable vanes, but rather have fixed vane setting angles. However, the IGVs are extendable and retractable into and out of the flow path 23. Thus, when the IGVs are extended as in FIG. 3A, they alter the swirl of the flow entering the impeller 22; when the IGVs are retracted as in FIG. 3B, the flow enters the impeller without being altered in swirl.

The OGVs 26' in this embodiment can be fixed (i.e., neither pivotable about their axes nor extendable and retractable). It should be noted that OGVs are not essential in the turbine mode.

Figure 4:
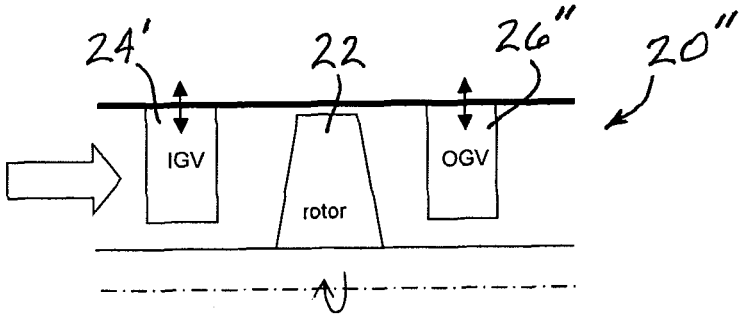
FIG. 4 is a diagrammatic illustration of an impeller assembly for a turbomachinery device in accordance with a further embodiment of the invention.

Alternatively, as shown in the impeller assembly 20" of FIG. 4, it is also possible to employ OGVs 26" that are fixed in setting angle and are extendable and retractable like the IGVs previously described. Thus, when the OGVs are extended as in FIG. 4, they alter the swirl of the flow exiting the impeller assembly 20; when the OGVs are retracted, the flow exits the impeller assembly without being altered in swirl.

Figure 5A:
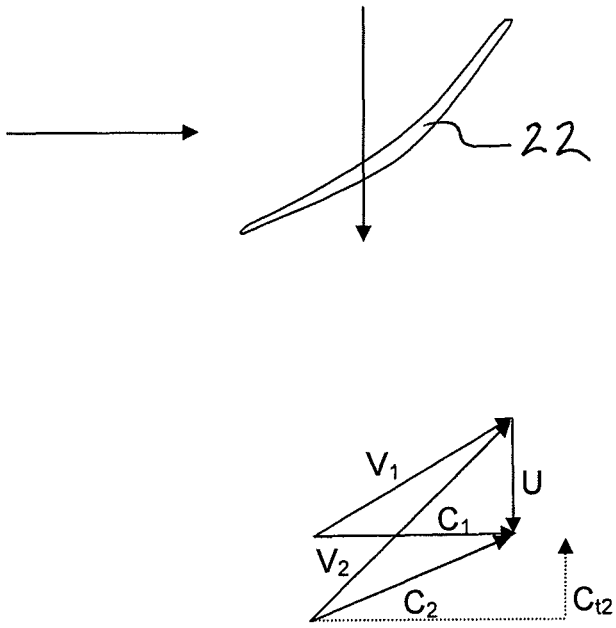
FIG. 5A shows a vector diagram for an impeller assembly for a turbomachinery device in accordance with one embodiment of the invention, operating in a turbine mode.
Figure 5B:
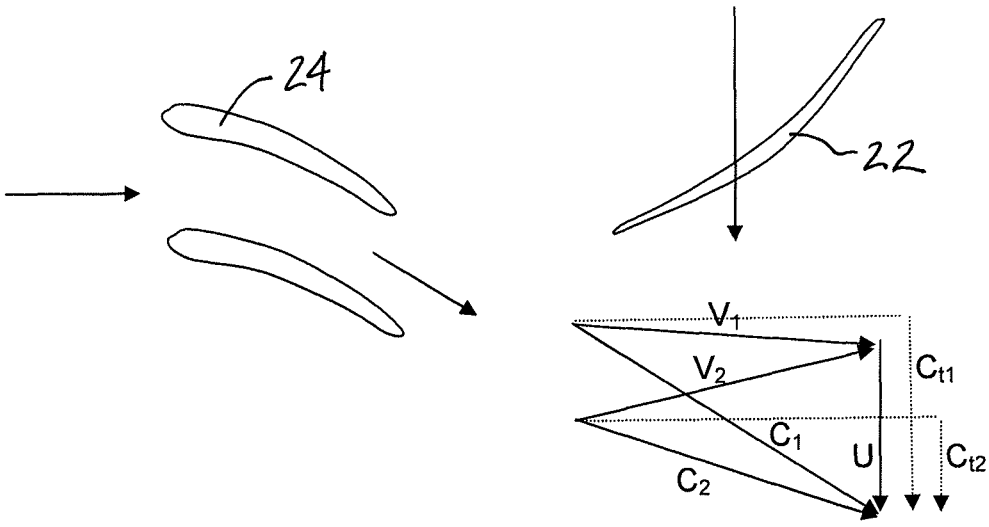
FIG. 5B shows a vector diagram for an impeller assembly having inlet guide vanes, operating in a turbine mode.
Figure 6:
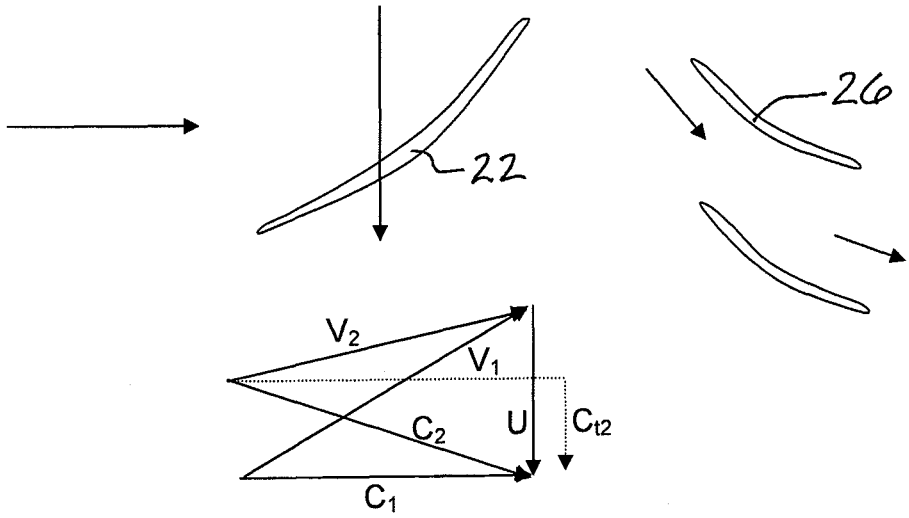
FIG. 6 shows a vector diagram for an impeller assembly for a turbomachinery device in accordance with yet another embodiment of the invention, operating in a compressor mode.

FIGS. 5 and 6 show several velocity diagrams for impeller assemblies in accordance with the invention, in both turbine and compressor modes of operation. FIG. 5A illustrates a turbine mode of operation where the flow enters the impeller 22 in the axial direction (without swirl, see velocity vector $C_1$) and the impeller is driven to rotate by the flow; thus, the section of impeller shown in FIG. 5A moves with a peripheral velocity U. The relative velocity at the impeller entrance is $V_1$ and the relative velocity at the impeller exit is $V_2$. The absolute velocity at the impeller exit is $C_2$. As shown, the absolute flow direction at the impeller exit includes a tangential or swirl component $C_{t2}$ that is opposite to the direction of impeller rotation, since the impeller is extracting power from the flow stream.

FIG. 5B illustrates a turbine mode of operation according to another embodiment. Inlet guide vanes 24 receive axial flow and impart pres-swirl (i.e., swirl in the same direction as the impeller rotation) to the flow entering the impeller 22. Thus, the absolute velocity $C_1$ has a tangential component $C_{t1}$ in the rotation direction. The impeller 22 is rotatably driven by the flow so that the impeller section shown in FIG. 5B moves with a peripheral velocity U. The relative velocity at the impeller entrance is $V_1$ and the relative velocity at the impeller exit is $V_2$. The absolute velocity at the impeller exit is $C_2$. As shown, the absolute flow direction at the impeller exit includes a tangential or swirl component $C_{t2}$ that is in the direction of impeller rotation, but is smaller in magnitude than the swirl component $C_{t1}$ at the impeller entrance, since the impeller is extracting power from the flow stream.

FIG. 6 shows a compressor mode of operation according to a further embodiment. Flow enters the impeller 22 in the axial direction (zero swirl). The impeller is rotatably driven (by the motor/generator 40—see FIG. 1B) to rotate with a peripheral velocity U. The impeller imparts swirl to the flow, such that the velocity exiting the impeller has a tangential component $C_{t2}$ in the rotation direction. The impeller thereby compresses the air (increasing its total pressure). Outlet guide vanes 26 are employed to reduce the swirl before the flow exits the impeller assembly. By turning the flow back toward axial, the absolute velocity of the flow is reduced, thereby diffusing the flow to increase its static pressure.

It will be noted from a comparison of FIGS. 5 and 6 that if the blades of the impeller 22 have a fixed camber, the camber can be in the "correct" direction for only one of the turbine and compressor modes of operation. Thus, the camber shown in the turbine mode of FIG. 5 is correct, but the camber is in the wrong direction for the compressor mode of FIG. 6. It is possible in accordance with the invention to shape the impeller blades to have a camber suitable for either the turbine mode or the compressor mode. Generally speaking, proper camber is more important for good efficiency in the compressor mode than in the turbine mode, because of the adverse pressure gradient on the boundary layer in the compressor mode. However, depending the needs of a particular application, it may still be desirable to select a blade camber more suitable to the turbine mode.

It is also possible to provide variable-camber impeller blades whose camber can be set to one camber value for the compressor mode and to another camber value for the turbine mode. For instance, the blades can employ shape memory alloy or can comprise composite blades such that the blade shape can be changed as desired.

When it includes variable-geometry inlet flow-guiding and/or outlet flow-guiding devices, the turbomachinery device 10 in accordance with the invention advantageously includes one or more actuators for moving the variable-geometry device(s). When both inlet and outlet flow-guiding devices are variable, the actuator mechanism (whether comprised of a single actuator for both devices, or two separate actuators) can be operable to position the inlet and outlet flow-guiding devices in dependence on each other. In other words, the position the actuator mechanism puts the inlet flow-guiding device in depends on the position it puts the out flow-guiding device in.

Inlet and outlet guide vanes have been specifically illustrated as examples of flow-guiding devices, but the invention is not limited to any particular type of flow-guiding devices. Thus, other types (e.g., volutes) can be used.

When the flow-guiding devices are of variable-geometry type, they can be, but need not necessarily be, continuously variable in position. For instance, binary (on/off) type variable-geometry mechanisms having only two possible positions (such as the variable IGVs and OGVs shown in FIGS. 3 and 4) can be used.

Figure 7:
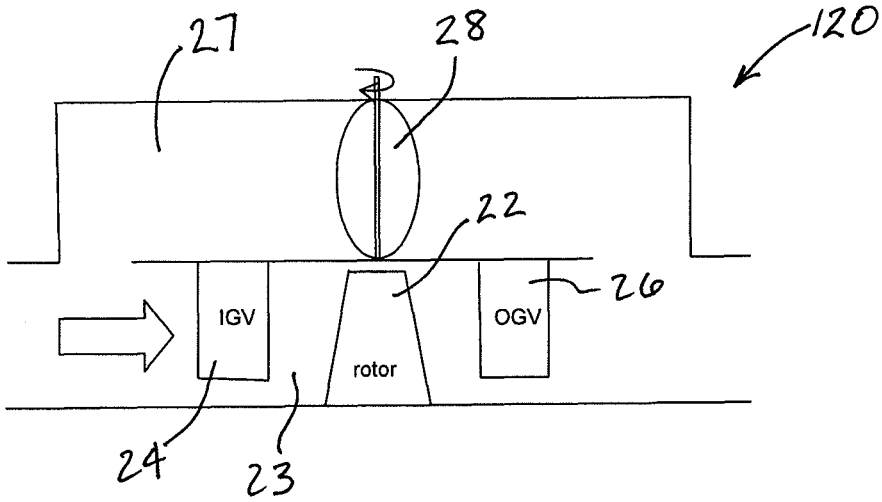
FIG. 7 is a schematic illustration of an impeller assembly in accordance with a further embodiment.

As shown in FIG. 7, an impeller assembly 120 is shown including a bypass passage 27 and a bypass valve 28 for bypassing the impeller 22. The bypass valve 28 is shown as a butterfly valve, but any type of valve can be used. When the valve 28 is closed, all of the flow passes through the main flow path 23. When the valve 28 is opened, some flow goes through the bypass passage 27 and bypasses the impeller 22. The valve 28 can be controlled to regulate whether and how much flow bypasses the impeller.

The turbomachinery device in accordance with the invention can be employed as an air throttling device in an engine system such as shown in FIG. 1. When the device is operated in the turbine mode, the air is expanded in the impeller, which acts like a throttle. Energy that would otherwise be lost in the throttling process is extracted by the impeller and the motor/generator converts it into electrical power that can be used to power other devices. When the device is operated in the compressor mode, the impeller acts like a supercharger to increase the pressure of the air delivered to the engine. Thus, the device can be operated in the different modes depending on engine operating conditions.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A turbomachinery device for selective compression of a fluid or extraction of power from the fluid, comprising:

an impeller disposed in a flow path and mounted for rotation about an axis, fluid flowing along the flow path through the impeller in a flow direction, the impeller rotating in a first direction about the axis;

a motor/generator coupled with the impeller, the motor/generator being selectively operable either as a motor to rotatably drive the impeller which in turn compresses the fluid, or as a generator to generate electrical power when the fluid rotatably drives the impeller;

wherein the turbomachinery device is selectively operable either in a compressor mode wherein the motor/generator is operated as a motor to rotate the impeller in the first direction to compress the fluid, or in a turbine mode wherein the fluid rotates the impeller in the first direction so as to rotate the motor/generator which produces electrical power; and an inlet flow-guiding device positioned upstream of the impeller with respect to the flow direction and structured and arranged to receive a flow of fluid and direct the fluid into the impeller, the inlet flow-guiding device being a variable-geometry mechanism that is selectively configurable in at least first and second positions, the first position causing the fluid to be directed into the impeller with a first swirl, the second position causing the fluid to be directed into the impeller with a second swirl.

2. The turbomachinery device of claim 1, wherein the impeller has blades that have fixed camber that is in a direction more suitable for the compressor mode than for the turbine mode.

3. The turbomachinery device of claim 1, wherein the impeller has blades that have fixed camber that is in a direction more suitable for the turbine mode than for the compressor mode.

4. The turbomachinery device of claim 1, wherein the impeller has variable-camber blades that are switchable between at least two different degrees of camber respectively suitable for the compressor mode and the turbine mode.

5. The turbomachinery device of claim 1, further comprising a bypass passage arranged for bypassing the impeller and a bypass valve that is controllable for regulating whether and how much flow bypasses the impeller via the bypass passage.

6. The turbomachinery device of claim 1, wherein the inlet flow-guiding device comprises a volute.

7. The turbomachinery device of claim 1, wherein the inlet flow-guiding device comprises an array of inlet guide vanes for regulating a direction in which the fluid enters the impeller, and an actuator mechanism coupled with the inlet guide vanes and operable to move the inlet guide vanes for changing how the inlet guide vanes direct the fluid into the impeller.

8. The turbomachinery device of claim 7, wherein the inlet guide vanes are pivotable about respective vane pivot axes and the actuator is operable to pivot the inlet guide vanes to change how the inlet guide vanes direct the fluid into the impeller.

9. The turbomachinery device of claim 7, wherein the inlet guide vanes are movable between an extended position and a retracted position, the inlet guide vanes in the extended position being positioned in the flow path so as to alter the direction in which the fluid enters the impeller, the inlet guide vanes in the retracted position being outside the flow path so as to have no influence on the direction in which the fluid enters the impeller, the actuator being operable to move the inlet guide vanes between the extended and retracted positions.

10. The turbomachinery device of claim 7, further comprising an array of outlet guide vanes positioned downstream of the impeller with respect to the flow direction and being operable for regulating a direction in which the fluid exits the turbomachinery device, wherein the actuator mechanism is coupled with the outlet guide vanes.

11. The turbomachinery device of claim 10, wherein the outlet guide vanes are pivotable about respective vane pivot axes and the actuator is operable to pivot the outlet guide vanes to change how the outlet guide vanes direct the fluid exiting the turbomachinery device.

12. The turbomachinery device of claim 10, wherein the outlet guide vanes are movable between an extended position and a retracted position, the outlet guide vanes in the extended position being positioned in the flow path so as to alter the direction in which the fluid exits the turbomachinery device, the outlet guide vanes in the retracted position being outside the flow path so as to have no influence on the direction in which the fluid exits the turbomachinery device, the actuator being operable to move the outlet guide vanes between the extended and retracted positions.

13. The turbomachinery device of claim 10, wherein the actuator mechanism is operable to position the inlet guide vanes and the outlet guide vanes in cooperation with each other as the turbomachinery device is switched between the compressor mode and the turbine mode.

14. A method for selectively expanding a fluid to extract energy therefrom or compressing the fluid, comprising the steps of:

directing the fluid into an impeller rotating in a first direction about an axis of the impeller, and selectively performing each of the following steps at different times:

directing the fluid into the impeller while concurrently adding power to the impeller to rotate the impeller in the first direction such that the impeller compresses the fluid passing through the impeller;

directing the fluid into the impeller such that the fluid causes the impeller to rotate in the first direction, while concurrently extracting power from the impeller, wherein the directing steps are performed with the aid of an inlet flow-guiding device comprising a variable-geometry mechanism that is selectively configurable in at least first and second positions, the first position causing the fluid to be directed into the impeller with a first swirl, the second position causing the fluid to be directed into the impeller with a second swirl different from the first swirl.

15. The method of claim 14, further comprising the step of guiding the fluid that has exited the impeller using an outlet flow-guiding device.

16. The method of claim 15, wherein the steps of adding power to and extracting power from the impeller are performed with a motor/generator selectively operable either as a motor to add power to the impeller or as a generator to extract mechanical power from the impeller and convert the mechanical power into electrical power.

17. The method of claim 15, further comprising each of the following steps performed at different times:

positioning the outlet flow-guiding device in one position when power is added to the impeller and the impeller compresses the fluid;

positioning the outlet flow-guiding device in another position when the impeller is rotated by the fluid and power is extracted from the impeller.

18. The method of claim 15, further comprising each of the following steps performed at different times:

positioning the outlet flow-guiding device in one position when the inlet flow-guiding device is in the first position;

positioning the outlet flow-guiding device in another position when the inlet flow-guiding device is in the second position.

19. The method of claim 18, further comprising employing an actuator mechanism to move the inlet flow-guiding device between the first position and the second position and to move the outlet flow-guiding device between the one position and the other position.

* * * * *